United States Patent [19]

Löfkvist

[11] Patent Number: 5,000,012

[45] Date of Patent: Mar. 19, 1991

[54] DEVICE FOR PRODUCING A HOMOGENEOUS FLOW OF A REFRIGERANT

[75] Inventor: Christer Löfkvist, Helsingborg, Sweden

[73] Assignee: Frigoscandia Contracting AB, Helsingborg, Sweden

[21] Appl. No.: 473,965

[22] PCT Filed: Oct. 25, 1988

[86] PCT No.: PCT/SE88/00565

§ 371 Date: Apr. 16, 1990

§ 102(e) Date: Apr. 16, 1990

[87] PCT Pub. No.: WO89/03964

PCT Pub. Date: May 5, 1989

[30] Foreign Application Priority Data

Oct. 28, 1987 [SE] Sweden ..... 8704183

[51] Int. Cl.[5] ..... F25D 17/02

[52] U.S. Cl. ..... 62/376; 62/64; 62/375

[58] Field of Search ..... 62/375, 376, 63, 64

[56] References Cited

U.S. PATENT DOCUMENTS 1,641,441 9/1927 Kolbe ..... 62/63

4,008,580 2/1977 Heber et al. ..... 62/376

*Primary Examiner*—Ronald C. Capossela

*Attorney, Agent, or Firm*—Browdy and Neimark

[57] ABSTRACT

The inventive device comprises a channel defined by a bottom and side walls having an inlet end and an outlet end for the flow of a refrigerant. Underneath the bottom there is provided transversely between the side walls an elongate first space. Substantially underneath the bottom and in association with the inlet end of the channel, an elongate second space is provided parallel to the first space. Between the first and the second space, at least one opening is so provided that a component of a flow rotating in the first space is guided substantially tangentially out of the first space and into the second space. The refrigerant therein is caused to rotate about the longitudinal axis of the second space, the second space being so connected to the inlet end of the channel that a component of the flow rotating in the second space is guided substantially tangentially out of the second space and in over the bottom so as to form a homogeneous flow of refrigerant in the channel.

9 Claims, 2 Drawing Sheets

DEVICE FOR PRODUCING A HOMOGENEOUS FLOW OF A REFRIGERANT

The present invention generally relates to a device for quick, partial or complete freezing of particulate products, such as food products, which are brought into direct contact with a refrigerant, and especially to an improved device for producing a homogeneous flow of the refrigerant directly contacting the food products.

US-A-4,008,580 discloses a device for providing a homogeneous flow of a refrigerant. This document shows a pipe for continuously feeding the refrigerant to a plurality of nozzles. The nozzles provide a substantially horizontal first flow portion. At a generally semicircular end wall, the flow of refrigerant is turned through about 180° to provide a substantially horizontal second flow portion moving in a direction contrary to that of the first flow portion. Further, this prior art device uses a baffle adapted to separate the first and second flow portions from each other. The baffle extends above and covers the nozzle outlets, but leaves a gap through which at least part of the second flow portion is recirculated so as to again join the first flow portion. The products to be frozen are supplied at the top into the pan defined by said end wall, side walls and a triangular weir. The products descend into the refrigerant and are carried by the refrigerant flow up to said weir. During this conveyance, the products are frozen, either completely or at least on the surface. Part of the refrigerant passes over the weir, entraining the products, while the rest of the refrigerant is recirculated.

The practical use of the prior art device has however met with several drawbacks. One drawback is the insufficient homogeneity of the second refrigerant flow portion. The homogeneity of this flow portion is in fact a decisive factor for correct operation of the device. The insufficient homogeneity, and thus the thickness of the layer having sufficient homogeneity, is dependent on a multitude of eddies forming without any control during the operation of the known device. These eddies adversely affect the homogeneity of the refrigerant flow and reduce both the thickness of the layer having sufficient homogeneity and the velocity of the second flow portion, at least at a distance below the surface of the flow.

This also explains another drawback of the known device, namely that part of the supplied products to be frozen is drawn down by eddies and may then freeze, for instance, onto the baffle separating the flow portions, or in the gap between the baffle and the triangular weir. A major collection of frozen products stuck in this gap may, if it comes to the worst, obstruct the recirculation of the refrigerant from the second flow portion, in which case the device will not operate properly. Furthermore, the entire freezer must be shut off at frequent intervals for cleaning the device with consequential economic losses.

One object of the present invention therefore is to provide an improved device for producing a homogeneous flow of a refrigerant, which flow is homogeneous throughout a greater length, a greater width and a greater depth as compared with the conventional technique.

Another object of the present invention is to provide a higher flow velocity of at least the homogeneous part of the refrigerant flow.

Yet another object of the present invention is to provide a device which is so compact that a freezer can be supplemented afterwards without any major problems.

These and other objects are achieved by means of a device for producing a homogeneous flow of a refrigerant, which device comprises a channel defined by a bottom and side walls and having an inlet end and an outlet end for the flow of refrigerant, and which device is characterised by an elongate first space disposed underneath said bottom and extending transversely between the side walls, an elongate second space disposed substantially underneath said bottom in association with the inlet end of the channel and being parallel to said first space, means for feeding the refrigerant into said first space in a manner to cause it to rotate about the longitudinal axis of said first space, and at least one opening which is so disposed between said first and said second space that a component of the flow rotating in said first space is guided substantially tangentially out of the first space and into the second space so as to cause the refrigerant therein to rotate about the longitudinal axis of the second space, said second space being so connected to the inlet end of the channel that a component of the flow rotating in the second space is guided substantially tangentially out of the second space and in over said bottom to form said flow in the channel.

With the features stated in the subclaims, there are achieved other advantageous improvements and embodiments of the device recited in the main claim for producing a homogeneous flow of a refrigerant.

The inventive device having the features stated in the characterising clause of the main claim provides a homogeneous flow of a refrigerant with which products to be frozen are directly contacted, which flow is homogeneous throughout a greater width, a greater length and a greater depth, as compared with the flow in a device according to the prior art. Moreover, while maintaining its homogeneity, the flow in the device according to the present invention can be given a higher flow velocity, which also permits individual freezing of such products, e.g. raw shrimps, as otherwise can be individually frozen only with great difficulty.

An embodiment of a device according to the invention for producing a homogeneous flow of a refrigerant will be described in more detail hereinbelow with reference to the accompanying drawings, in which:

FIG. 1 schematically illustrates one example of a location of a device according to the present invention in a freezer;

Figure 1:
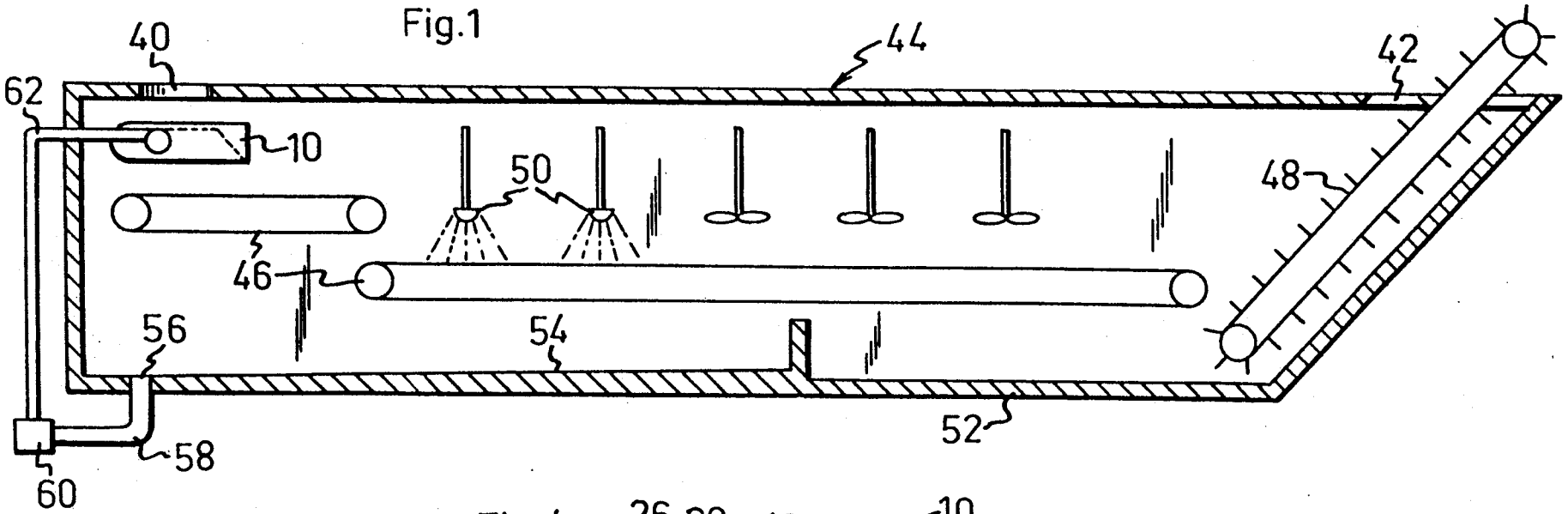

FIG. 1 highly schematically shows an example of a known freezer comprising a new device 10 for producing a homogeneous flow of a refrigerant which preferably is a gas in the liquid state, especially liquid nitrogen. The freezer has a top side 44 with openings 40, 42. A feed opening 40 is provided above the inventive device 10. For conveying the products through the freezer, a plurality of conveyors 46 are provided. A discharge conveyor 48 conveys the frozen products out of the freezer. To ensure complete freezing of the products, nozzles 50 are provided above at least one of the conveyors 46. The nozzles 50 spray preferably liquid nitrogen over the partially frozen products. Excess refrigerant drips from the conveyors 46 onto the freezer bottom 52 of which at least a portion 54 is slightly inclined downwards towards the end remote from the discharge conveyor 48. At the lowermost point of the inclined portion 54, there is an opening 56 which via a first conduit 58 is connected to a pump 60. The pump 60 pumps the refrigerant through a second conduit 62, both to the inventive device 10 and to the nozzles 50.

Figure 4:
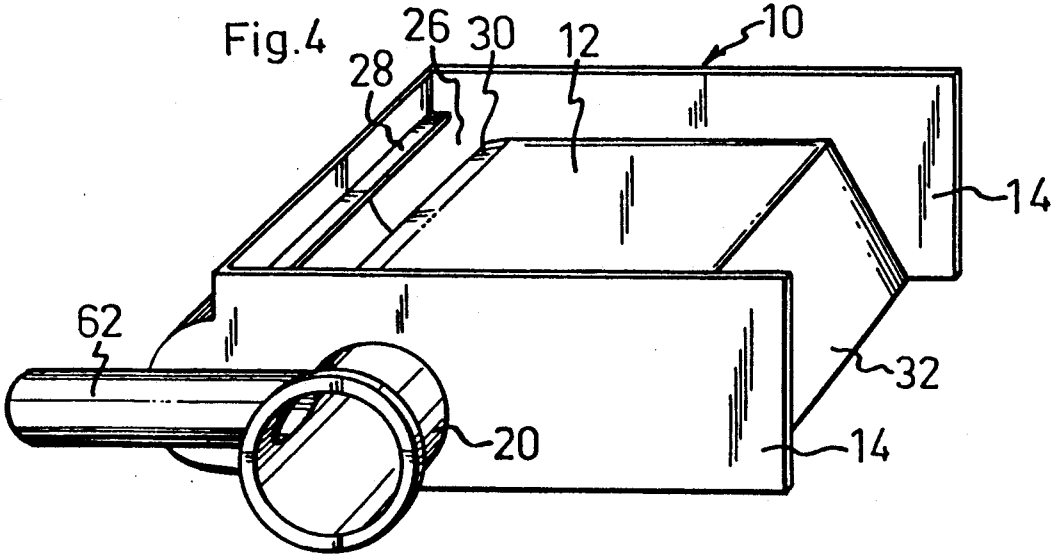
FIG. 4 is a perspective view of the device according to the present invention where, for purposes of clarity, one end of a first space is shown without a covering end wall.
Figure 2:
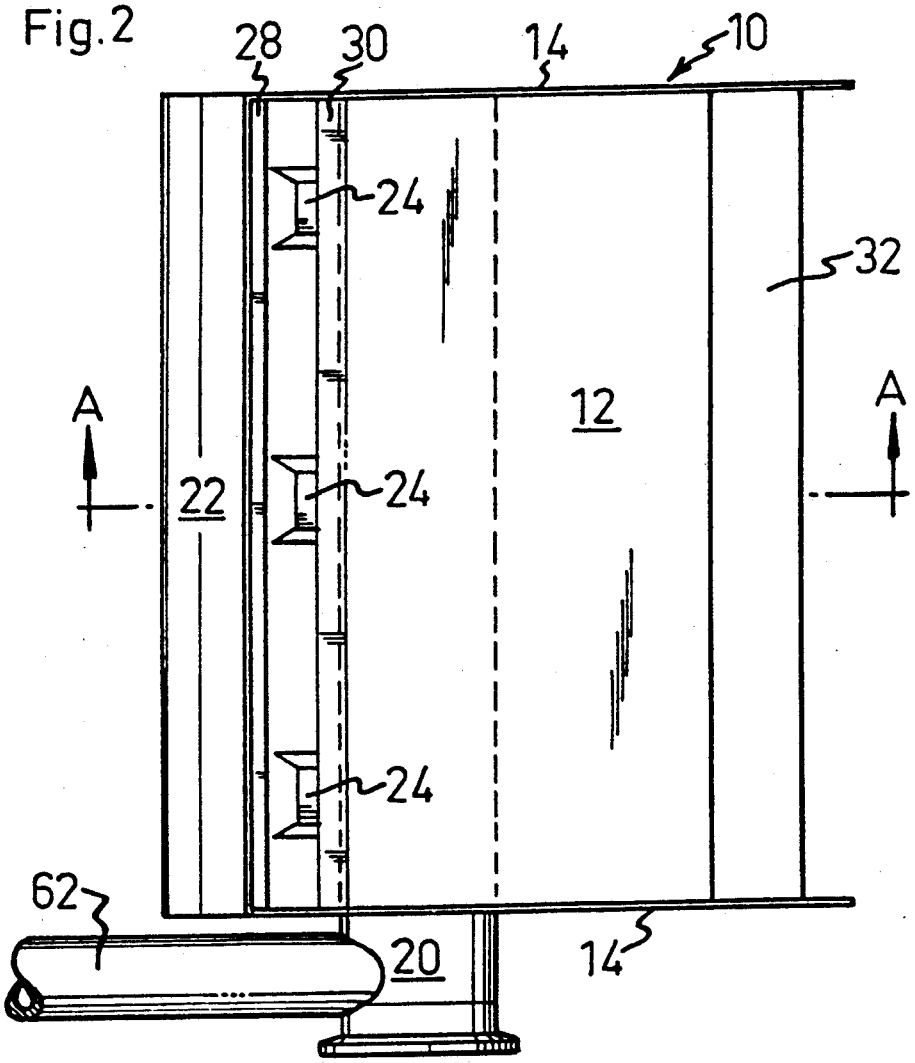
FIG. 2 is a top plan view of the device according to the present invention.
Figure 3:
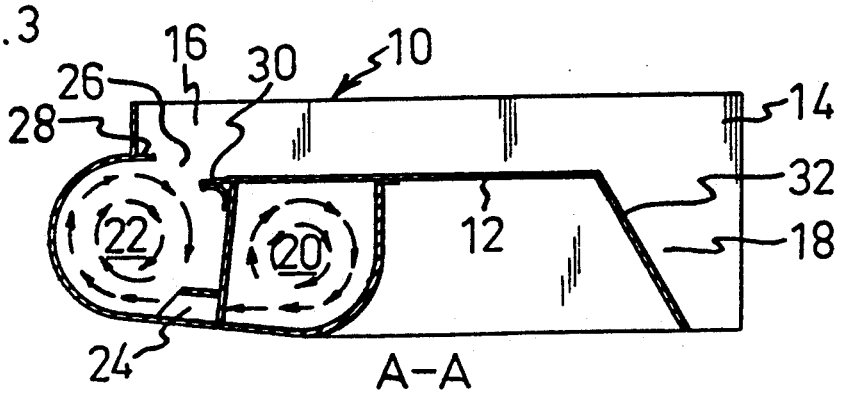
FIG. 3 is a section of the device according to the present invention taken along the line A—A in FIG. 2.

In FIGS. 2–4, and especially FIG. 3, the inventive device 10 is illustrated in more detail. The device 10 comprises a pan or channel defined by a bottom 12 and side walls 14 and having an inlet end 16 and an outlet end 18 for the flow of refrigerant. Underneath the bottom 12, there is provided an elongate first space 20 which extends transversely between the side walls 14 and to which the second conduit 62 is connected substantially tangentially.

An elongate second space 22, parallel to the first space 20, is disposed substantially underneath said bottom 12 in association with the inlet end 16 of the channel. Between the spaces 20, 22, an opening or a plurality of openings are provided which may consist, for instance, of a slot extending in the longitudinal direction of the spaces 20, 22 or of a plurality of nozzles 24. The second space 22 has a generally circular cross-section and is so connected to the inlet end 16 of the channel that a component of the flow rotating in the second space 22 can be guided substantially tangentially out through an opening 26 in the second space 22 and in over said bottom 12. At a distance above the bottom 12, there is provided an elongate horizontal strip 28 which is fixed to and extends along the second space 22 as an upper edge thereof. The end of the bottom facing the outlet 26 of the second space 22 may have a flow-promoting guide rail which in a preferred embodiment of the present invention consists of an elongate fillet 30. The opposite end of the bottom is connected to a downwardly inclined plane 32.

The products to be frozen are delivered in any suitable manner to the feed opening 40 in the top side 44 of the freezer shown in FIG. 1. The pump 60 pumps the refrigerant, for instance liquid nitrogen, from the sloping bottom portion 54 of the freezer through the opening 56, the first conduit 58 and the second conduit 62 to the inventive device 10. The second conduit 62 opens substantially tangentially into the first space 20 of the device 10, whereby the refrigerant is caused to rotate about the longitudinal axis of the first space 20. A slot or a plurality of openings 24 between the first space 20 and the second space 22 are so arranged that a component of the flow rotating in the first space 20 is led substantially tangentially out of the first space 20 and into the second space 22. In this manner, the refrigerant in the second space 22 is caused to rotate about the longitudinal axis of the space 22 which is so connected to the inlet end 16 of the channel that a component of the flow rotating in the second space 22 is guided substantially tangentially out of the second space 22 and in over said bottom 12 to produce the desired flow in the channel. To facilitate the production of the rotational movement about the longitudinal axis of the second space, the openings or the nozzles 24 are so arranged between the respective lower portions of the first and second spaces as to form, in the direction of movement of the tangential flow component from the first space 20 and in relation to the horizontal plane, a slightly upwardly inclined plane. The elongate horizontal strip extending along the second space 22 as an upper edge thereof is adapted to guide the tangential component from the second space 22 in over the bottom 12 of the channel. This guiding effect is enhanced by a flow-promoting guide rail 30 which is fixed to the inlet end of the bottom and arranged to guide both the tangential component from the second space 22 in towards the bottom 12 of the channel and the flow in the second space 22 in a substantially circular path about the longitudinal axis of the second space. In a preferred embodiment of the present invention, this guide rail is a fillet.

The flow produced at the bottom of the channel is homogeneous throughout the entire width of the channel and the entire length of the bottom and down to a relatively great depth.

The products (not shown) delivered to the feed opening 40 of the freezer drop through the opening and down into the homogeneous flow prevailing in the channel. Since this flow has a high velocity, the products to be frozen will not stick to each other but are separated, such that the device 10 allows individual freezing also of such products as have earlier been difficult to freeze in this manner, for instance raw shrimps.

If liquid nitrogen ($N_2$), having a relatively low specific weight, is used as refrigerant, the products will be surface-frozen.

With the homogeneous flow, the products are conveyed to the downwardly inclined plane 32 associated with the bottom 12 of the channel. Via this plane 32, the products will be supplied onto the conveyor 46. The foraminated belt thereof will separate the products from the refrigerant, and the products are conveyed further through the freezer for additional and/or supplementary treatment. The refrigerant flows through the perforations of the belt and is collected in the inclined trough-like bottom portion 54 of the freezer, from where it is again pumped up to the inventive device 10.

The ready-treated products are finally discharged from the freezer by means of the discharge conveyor 48.

The advantages gained by the present invention can be summed up as follows:

(1) The substantially tangential feed of the refrigerant into the first space and the provision of a second space parallel to the first space and connected thereto via openings provide a wide, long and deep, homogeneous flow.

(2) The homogeneity characteristics of the flow and its high velocity allow individual freezing also of products which generally are difficult to freeze in this manner and prevent the products from freezing onto the channel, which reduces the need to stop the freezer for cleaning the channel.

(3) In the described embodiment, the number of undesired eddies is minimized for maximum homogeneity of the flow in the channel.

(4) The inventive device is so compact that it can be mounted on a freezer afterwards without any appreciable problems.

Modifications and variants of the inventive device as illustrated in FIGS. 2-4 and alternative locations thereof are of course possible, all such modifications and variants being considered to be comprised by the accompanying claims.

I claim:

1. Device for producing a homogeneous flow of a refrigerant, which device (10) comprises a channel defined by a bottom (12) and sides walls (14) and having an inlet end (16) and an outlet end (18) for the flow of refrigerant, characterised by an elongate first space (20) disposed underneath said bottom (12) and extending transversely between the side walls (14), an elongate second space (22) disposed substantially underneath said bottom (12) in association with the inlet end (16) of the channel and being parallel to said first space (20), means (62) for feeding the refrigerant into said first space (20) in a manner to cause it to rotate about the longitudinal axis of said first space, and at least one opening (24) which is so disposed between said first and said second space (20 and 22, respectively) that a component of the flow rotating in said first space (20) is guided substantially tangentially out of the first space (20) and into the second space (22) so as to cause the refrigerant therein to rotate about the longitudinal axis of the second space, said second space (22) being so connected to the inlet end (16) of the channel that a component of the flow rotating in the second space (22) is guided substantially tangentially out of the second space (22) and in over said bottom (12) to form said flow in the channel.

2. Device as claimed in claim 1, characterised by means (60) for feeding the refrigerant into said first space (20) via a conduit (62) opening substantially tangentially into said first space (20) at one end thereof.

3. Device as claimed in claim 1, characterised by an elongate horizontal strip (28) disposed at a distance above the bottom (12) and extending along the second space (22) as an upper edge thereof for guiding said substantially tangential component from the second space (22) in towards the bottom (12) of the channel.

4. Device as claimed in claim 1 characterised by three openings (24) forming nozzles and disposed between said first and said second space (20 and 22, respectively).

5. Device as claimed in claim 4, characterised in that the nozzles (24) are disposed between the respective lower parts of said first and said second space, said lower parts forming, in the direction of movement of the tangential flow component from the first space (20) and in relation to the horizontal plane, a slightly upwardly inclined plane.

6. Device as claimed in claim 1, characterised in that the opening between the first and the second space (20 and 22, respectively) is a slot.

7. Device as claimed in claim 1, characterised in that the bottom (12) is substantially horizontal and connected to a downwardly inclined plane (32) at the outlet end (18) of the channel.

8. Device as claimed in claim 1, characterised in that the bottom (12) at the inlet end (16) of the channel has a flow-promoting guide rail (30) for guiding both the substantially tangential component from the second space (22) in towards the bottom (12) of the channel, and the flow in the second space (22) in a substantially circular path about the longitudinal axis of the second space.

9. Device as claimed in claim 8, characterised in that the guide rail (30) is a fillet.

* * * * *